United States Patent [19]

Komaki et al.

[11] 4,138,841

[45] Feb. 13, 1979

[54] ELECTRONIC TIMEPIECE

[75] Inventors: Shojiro Komaki; Nobuo Shimotsuma, both of Tokyo, Japan

[73] Assignee: Kabushiki Kaisha Daini Seikosha, Japan

[21] Appl. No.: 738,461

[22] Filed: Nov. 3, 1976

[30] Foreign Application Priority Data

Nov. 4, 1975 [JP] Japan ..... 50-132349

[51] Int. Cl.[2] ..... G04C 3/00

[52] U.S. Cl. ..... 58/23 R; 58/23 D; 58/85.5

[58] Field of Search ..... 58/23 R, 50 R, 23 D, 58/85.5; 310/40 MM

[56] References Cited

U.S. PATENT DOCUMENTS

| | | | |
|---|---|---|---|
| 3,939,644 | 2/1976 | Wolf | 58/85.5 X |
| 3,943,696 | 3/1976 | Portmann et al. | 58/23 R |
| 3,953,964 | 5/1976 | Suppa et al. | 58/85.5 X |

*Primary Examiner*—Ulysses Weldon

*Attorney, Agent, or Firm*—Robert E. Burns; Emmanuel J. Lobato; Bruce L. Adams

[57] ABSTRACT

An electronic timepiece comprising an oscillating circuit for producing a standard time signal, a dividing circuit for dividing the output signal of said oscillating circuit and a driving circuit. The output signal of said driving circuit is controlled by a controlling circuit cooperative with the dividing circuit for changing the division of the standard time signal.

8 Claims, 4 Drawing Figures

ELECTRONIC TIMEPIECE

BACKGROUND OF THE INVENTION

This invention relates to an electronic timepiece having a circuit compensating for the backlash of a toothed wheel when the toothed wheel is operated to correct timesetting.

Conventionally, in an electronic timepiece which displays the time with the toothed wheel mechanism, the prevention of backlash at the second hand adjustment has been accomplished in the mechanical manner.

For example, in the conventional electronic circuit as shown in FIG. 1, the switch 4 is synchronized with the timepiece stem and the driving circuit 3 does not act since the dividing circuit 2 stops acting in the ON state of the switch 4.

Accordingly, the output signal of the display is not produced at the output terminal 6.

In this time, the operation of the toothed wheel such as second hand adjustment is made.

The switch 4 becomes OFF state when the stem is disposed in the predetermined place after the completion of the toothed wheel operation.

Accordingly, the output signal of the display is produced at the output terminal 6.

In this time, the electronic timepiece starts to operate on instantly in the case that the mechanism for preventing the backlash is included in the electronic timepiece.

On the other hand, the second hand for displaying the time does not operate until the backlash becomes null whereby the electronic timepiece has seemingly a great error in displaying the time.

And also, there has been no manner for compensating the backlash with an electronic circuit.

SUMMARY OF THE INVENTION

The object of this invention is to provide an electronic timepiece compensating for backlash with an electronic circuit.

And another object of this invention is to provide an electronic timepiece eliminating the complicated conventional backlash compensation mechanism and the resultant difficulty of the time adjustment.

DESCRIPTION OF THE PREFERRED EMBODIMENT

Figure 1:
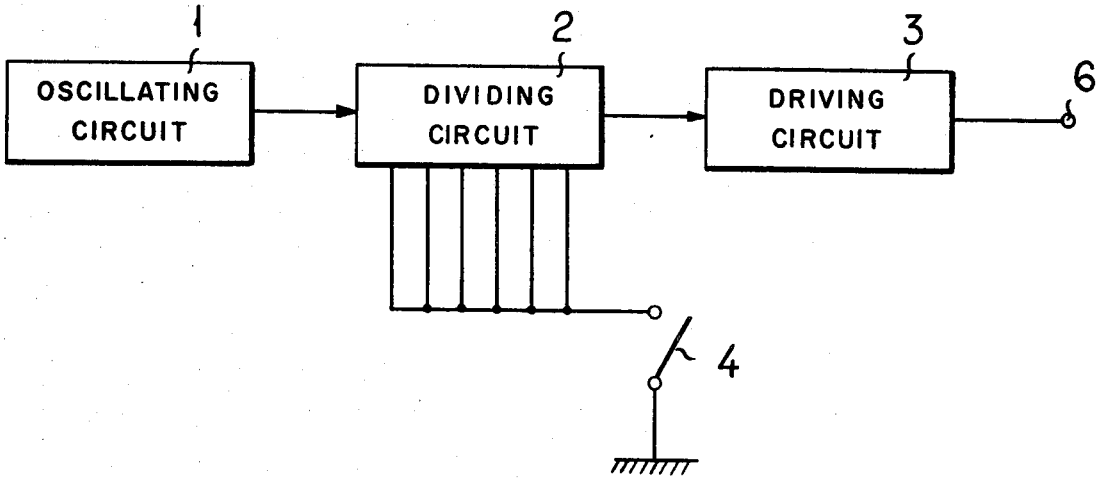
FIG. 1 PRIOR ART
FIG. 1 is a block diagram of a conventional electronic timepiece circuit.
Figure 2:
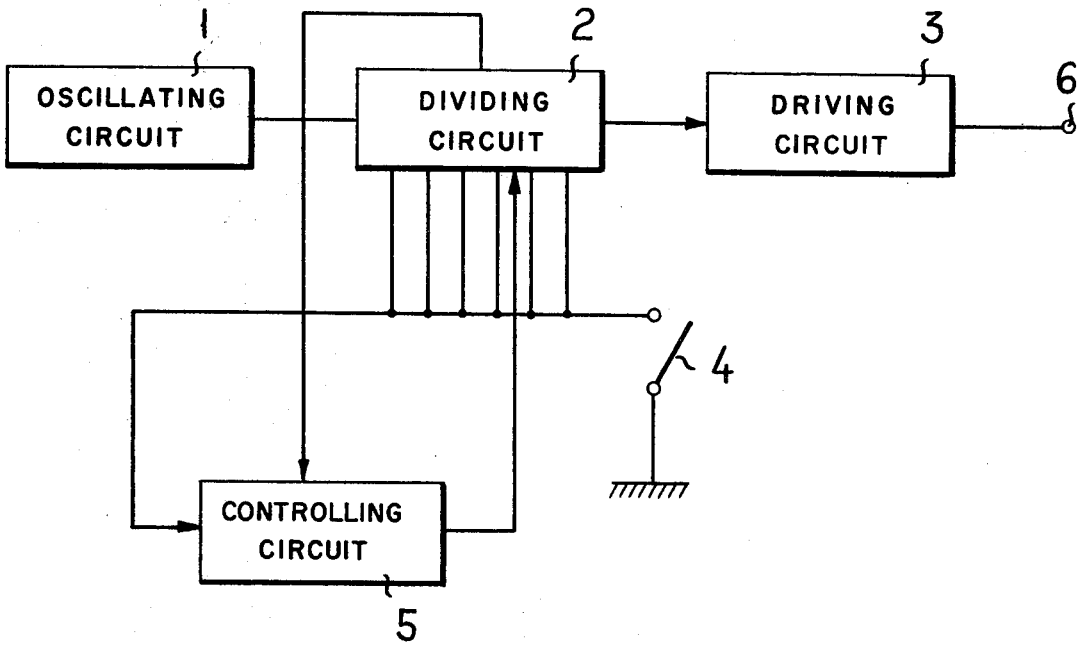
FIG. 2 is a block diagram of the electronic timepiece circuit according to the present invention.

The reference numeral 1 depicts an oscillating circuit which develops a time standard signal applied to the dividing circuit, the reference numeral 3 depicts the driving circuit 3. The reference numeral 4 depicts a switch, the reference numeral 5 depicts a controlling circuit and the reference numeral 6 depicts an output terminal. The output signal produced from the output terminal 6 by the driving circuit 3 connected to the dividing circuit 2 has a repetition rate dependent on the dividing circuit 2 which receives the output signal derived from the oscillating circuit 1.

The switch 4 is connected to the dividing circuit 2 and the controlling circuit 5.

The controlling circuit 5 is operated with the signal of the dividing circuit 2 and the signal of the switch 4 so that the dividing circuit 2 receives the output signal of the controlling circuit 5.

Figure 3:
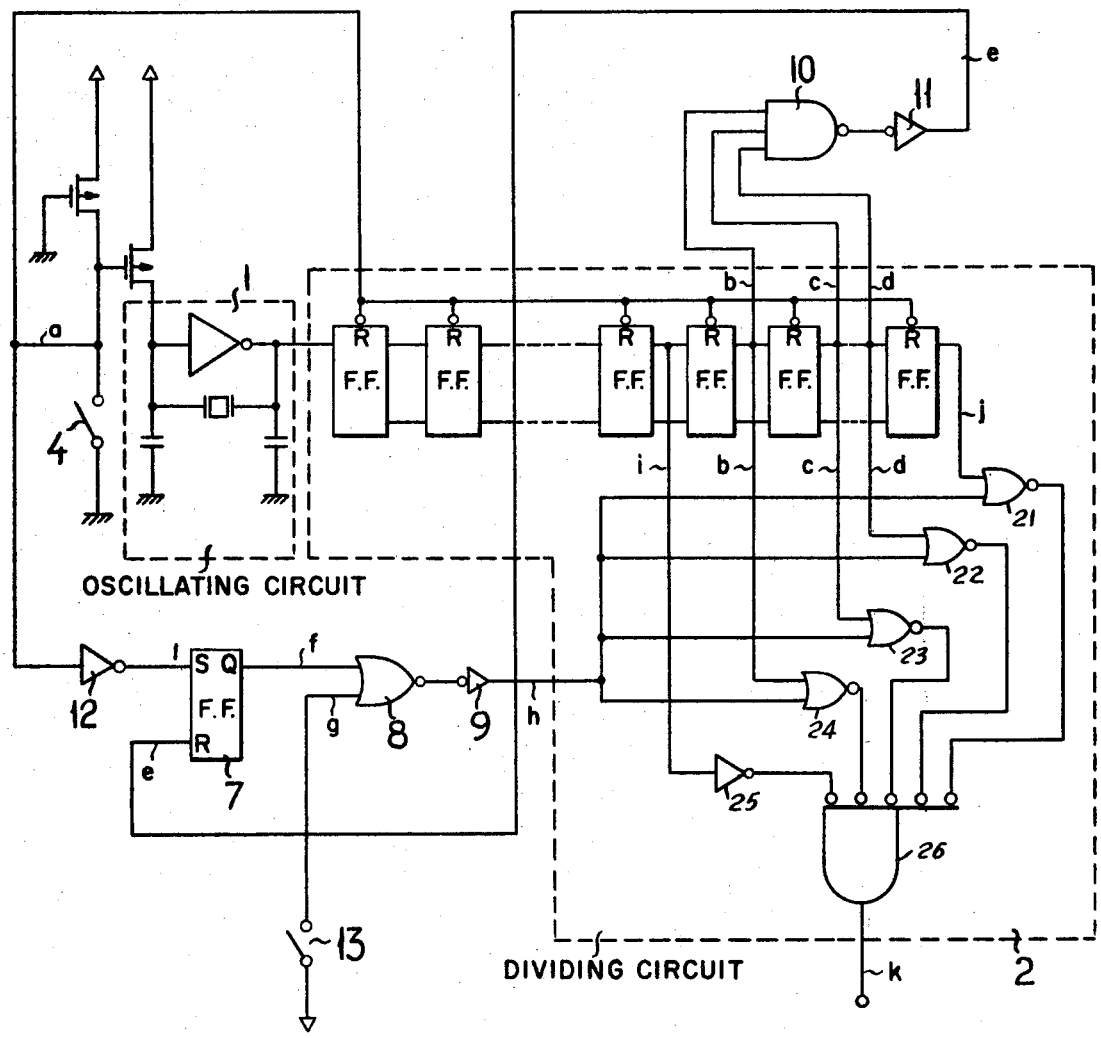
FIG. 3 illustrates the circuit of one embodiment of the present invention.
Figure 4:
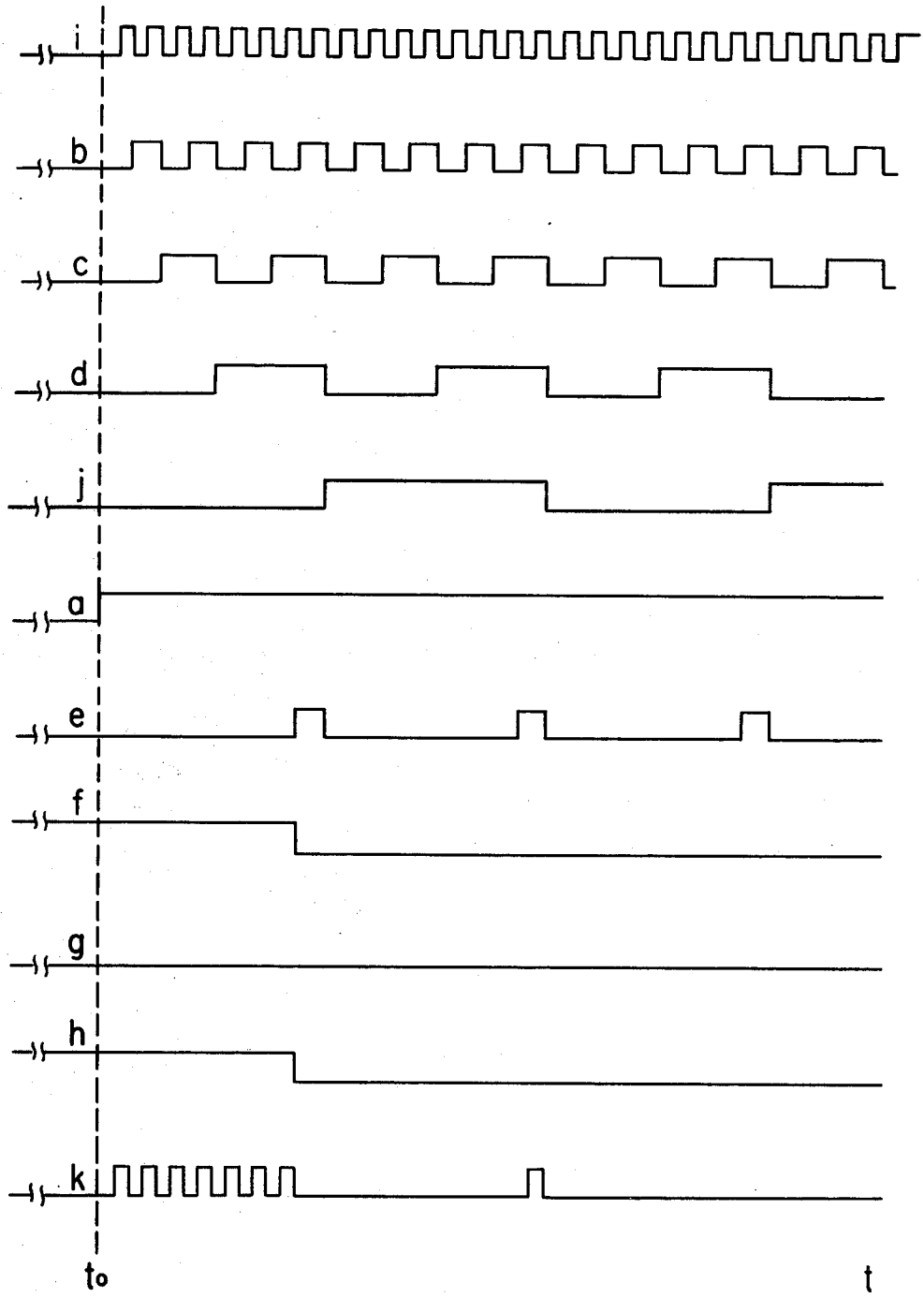
FIG. 4 is a timing chart of waveforms developed during operation of the embodiment shown in FIG. 3.

Referring next to FIGS. 3 and 4 showing one embodiment of the invention, the reference numerals 7, 8, 9, 10, 11, 12 and 13 respectively are an RS flipflop, a NOR gate, an inverter, a NAND gate, an inverter, an inverter and a speedy feed switch.

FIG. 4 shows the timing chart of the signals developed during operation of the embodiment of FIG. 3.

Assuming that the switch 4 is in the OFF state when the electronic timepiece is operating, the switch 4 is switched to the ON state when the second hand adjustment is made, and then switched back to the OFF state at the time to when the second hand adjustment is complete. Accordingly, the state of the terminal a becomes logical level "O" during second hand adjustment.

And after the second hand adjustment is made, the switch 4 is switched to the OFF state whereby the state of the terminal a becomes the logical level "l". Accordingly, the dividing circuit 2 having a plurality of the dividing stages starts to count from the resetting of it.

In this time, the state of the output signal f of the RS flipflop becomes logical level "l" and the state of the terminal h becomes level "l". Accordingly, the output pulse train derived from the terminal i is produced from the terminal k.

The state of the terminal f becomes logical level "O" since the RS flipflop 7 resets when the state of the output terminal of the inverter 11, namely the terminal e, becomes logical level "l".

In this time, although the counter uses the dividing circuit 2, it is possible to use another counter.

When the state of the terminal f becomes logical level "O", the state of the terminal h becomes logical level "O". Accordingly, the normal output pulse train produced from the terminal k is the logical AND combination of the signals produced from; the terminals i, b, c, d and j.

The plurality of gate circuits 21–26 comprise timing signal control means which is responsive to a control signal applied thereto from node h for changing the repetition rate of the timing signal generated by the dividing circuit 2. The timing signal control means is comprised of a plurality of first gate circuits 21–25 each connected to receive an output signal from respective flip-flop stages of the dividing circuit, and a second gate circuit 26 which is connected to receive respective output signals from the first gate circuits and which develops the timing signal generated by the dividing circuit.

Assuming now that the state of the terminal k is logical level "l" with the operation of the speedy feed switch 13, a pulse train is produced from the terminal k in the same manner as the pulse train is produced from the terminal k when the switch 4 changes from the ON state to the OFF state.

As mentioned the above, the backlash of the present invention is effective to eliminate toothed wheel without using a complicated mechanism.

And also, in the timepiece not having the backlash preventing mechanism, the display error mentioned above is eliminated by the electronic circuit according to the present invention.

And further, the second hand adjustment in the conventional manner needs a complicated mechanism for carrying out the reverse rotation of the second hand and also compensate for backlash. According to this invention, the need for such mechanism is eliminated.

We claim:

1. In an electronic timepiece:

an oscillator circuit for generating a repetitive time standard signal; a dividing circuit receptive of said repetitive time standard signal for dividing the same and for generating a repetitive timing signal having a repetition rate defining an interval of time, said dividing circuit including timing signal control means responsive to a control signal for changing the repetition rate of said timing signal generated by said dividing circuit, and said dividing circuit including resetting means responsive to a reset signal applied thereto for resetting said dividing circuit; reset signal generating means for generating a reset signal and for applying the reset signal to said resetting means to reset said dividing circuit; control signal generating means responsive to the reset signal and cooperative with said dividing circuit for generating a control signal and for applying the control signal to said timing signal control means during a predetermined interval after termination of said reset signal so that said dividing circuit develops a timing signal having a first repetition rate during the predetermined interval and for thereafter terminating the control signal so that said dividing circuit thereafter develops a timing signal having a second repetition rate.

2. In an electronic timepiece according to claim 1: wherein said dividing circuit is comprised of a plurality of flip-flop stages connected in cascade and each including means responsive to the reset signal for resetting the flip-flop stages; and wherein said resetting means of said dividing circuit is comprised of the respective means responsive to the reset signal of each of said flip-flop stages.

3. In an electronic timepiece according to claim 2: wherein said timing signal control means is comprised of a plurality of first gate circuits each connected to receive an output signal from a respective flip-flop stage of said dividing circuit; a second gate circuit connected to receive respective output signals from said first gate circuits and for developing as an output signal the timing signal generated by said dividing circuit; and means for applying the control signal to enable selected ones of said first gate circuits for controlling the signals applied to said second gate circuit and thereby controlling the repetition rate of the timing signal developed by said second gate circuit.

4. In an electronic timepiece according to claim 2: wherein said reset signal generating means is comprised of a switch connected for controlling application of an electrical signal to said resetting means of said dividing circuit.

5. In an electronic timepiece according to claim 2: wherein said control signal generating means is comprised of a set/reset flip-flop circuit; means for applying the output of said set/reset flip-flop circuit as said control signal to said dividing circuit; means for applying the reset signal to enable said set/reset flip-flop circuit to develop said control signal; and means cooperative with said divider circuit for disenabling said set/reset flip-flop circuit to terminate said control signal after the predetermined interval.

6. In an electronic timepiece according to claim 5: wherein said means for applying the reset signal is comprised of an inverter circuit connected to the set input of said set/reset flip-flop circuit; and wherein said means for disenabling is comprised of a gate circuit having a plurality of inputs connected to outputs of respective ones of said divider stages and having an output connected to the reset input of said set/reset flip-flop.

7. In an electronic timepiece according to claim 5: wherein said means for applying the output signal of said set/reset flip-flop circuit is comprised of a gate circuit having a first input connected to the output of said set/reset flip-flop circuit and a second input; a switch connected for controlling application of an electrical signal to said second input; and an output for developing said control signal, whereby said control signal is determined by both the state of said set/reset flip-flop and the setting of said switch.

8. In an electronic timepiece according to claim 5: wherein said oscillating circuit includes means responsive to said reset signal for disenabling said oscillating circuit to terminate generation of said time standard signal when said dividing circuit is in the reset condition.

* * * * *